US009055806B2

(12) United States Patent
Ferrer Wetter

(10) Patent No.: US 9,055,806 B2
(45) Date of Patent: Jun. 16, 2015

(54) ERGO CARGO

(76) Inventor: Felipe Alfredo Ferrer Wetter, Santiago (CL)

( * ) Notice: Subject to any disclaimer, the term of this patent is extended or adjusted under 35 U.S.C. 154(b) by 474 days.

(21) Appl. No.: 12/964,151

(22) Filed: Dec. 9, 2010

(65) Prior Publication Data

US 2011/0163139 A1 Jul. 7, 2011

(30) Foreign Application Priority Data

Dec. 10, 2009 (CL) ..... 2166-2009

(51) Int. Cl.
*A45F 3/10* (2006.01)
*A45F 3/14* (2006.01)
*A45F 3/08* (2006.01)

(52) U.S. Cl.
CPC .... *A45F 3/08* (2013.01); *A45F 3/10* (2013.01)

(58) Field of Classification Search
USPC ..... 224/265, 266, 257, 263
See application file for complete search history.

(56) References Cited

U.S. PATENT DOCUMENTS

| | | | | | |
|---|---|---|---|---|---|
| 744,477 | A | * | 11/1903 | Bush | 224/265 |
| 909,217 | A | * | 1/1909 | Presba et al. | 224/201 |
| 1,281,822 | A | * | 10/1918 | Orr | 224/604 |
| 1,627,847 | A | * | 5/1927 | Harold | 224/187 |
| 2,060,751 | A | * | 11/1936 | Baxter | 224/261 |
| 2,089,402 | A | * | 8/1937 | Murray | 224/624 |
| 2,271,136 | A | * | 1/1942 | Geiger | 224/200 |
| 3,322,312 | A | * | 5/1967 | Mitchell | 224/635 |
| 3,547,322 | A | * | 12/1970 | Dawson et al. | 224/148.2 |
| 3,679,107 | A | * | 7/1972 | Perrine | 224/201 |
| 4,213,605 | A | * | 7/1980 | McPeak | 482/105 |
| 4,280,645 | A | * | 7/1981 | Goodden | 224/259 |
| 4,722,524 | A | * | 2/1988 | Waszkelewicz | 482/106 |
| 4,799,610 | A | * | 1/1989 | Hsieh | 224/266 |
| D302,073 | S | * | 7/1989 | Biggs | D3/230 |
| 4,892,240 | A | * | 1/1990 | Bell | 224/628 |
| 5,118,100 | A | * | 6/1992 | Sungaila | 482/105 |
| 5,183,194 | A | * | 2/1993 | Shirdavani | 224/634 |
| 5,211,615 | A | * | 5/1993 | Sides | 482/105 |
| 5,333,768 | A | * | 8/1994 | Krentz | 224/623 |
| 5,464,137 | A | * | 11/1995 | Shirdavani | 224/265 |
| 5,499,965 | A | * | 3/1996 | Sanchez | 602/19 |
| 5,560,046 | A | * | 10/1996 | Iwamasa et al. | 2/328 |
| 5,692,661 | A | * | 12/1997 | Kellerman | 224/648 |
| 5,846,169 | A | | 12/1998 | Tscheschlog | |
| 6,155,764 | A | * | 12/2000 | Russo | 414/11 |
| 6,450,377 | B1 | * | 9/2002 | Oriolo | 224/266 |
| 6,790,201 | B2 | * | 9/2004 | Meyer | 604/345 |

(Continued)

FOREIGN PATENT DOCUMENTS

| | | |
|---|---|---|
| FR | 2718956 | 10/1995 |
| FR | 2825587 | 12/2002 |

(Continued)

*Primary Examiner* — Justin Larson
*Assistant Examiner* — Lester L Vanterpool
(74) *Attorney, Agent, or Firm* — Hasse & Nesbitt LLC; Daniel F. Nesbitt

(57) ABSTRACT

A device for the manual transportation of loads that includes at least a front surface and at least a back surface, where said front and back surfaces are defined according to their position on the body of the user, joined through their top portion by at least one flat surface, to each one of the front and back surface to which at least one pillar is added, wherein said pillar is coupled by means of its top portion to the lower portion of the front and back sections and through the lower portion of said at least one pillar is coupled to at least one girdle.

22 Claims, 3 Drawing Sheets

(56) References Cited

U.S. PATENT DOCUMENTS

| | | | | |
|---|---|---|---|---|
| 7,210,605 | B2 * | 5/2007 | Willows et al. | 224/637 |
| 7,275,668 | B1 * | 10/2007 | Carroll | 224/190 |
| 8,496,143 | B1 * | 7/2013 | Joseph | 224/257 |
| 2003/0125170 | A1 * | 7/2003 | Vernon | 482/124 |
| 2005/0228325 | A1 | 10/2005 | Zours et al. | |
| 2006/0151558 | A1 * | 7/2006 | Higgins | 224/636 |

FOREIGN PATENT DOCUMENTS

| | | |
|---|---|---|
| JP | 2004-283423 | 10/2004 |
| JP | 2006-305290 | 11/2006 |

* cited by examiner

ERGO CARGO

Manual transportation of loads has been a common practice around the world, among the most frequent activities, the following can be mentioned: harvesting of fruits and vegetables (specially in the cases of products called "premium"), the action of loading and unloading, transportation of loads in reduced space, and others.

Workers performing said activities, experiment lesions much more frequently than workers in other production areas, this is due to performing physical efforts in an incorrect way or caused by the physical wear produced by the activity itself. Among the most frequent lesions, the following can be mentioned; muscular sprain, hernias, lumbago, etc. The invention described herein proposes an exo-skeletal device, that prevents risky postures during the transportation of loads and also allows a better distribution of the load, reducing this way, the risk of lesions and allows the improvement of the efficiency of the user, also the effort that has to be made for the carrying of the load is reduced when the device proposed in this invention is used.

STATE OF THE ART

Actually, the skeletal muscle disorders (SMD) related with physical work load represents a growing importance subject. Two large groups can be distinguished, based on the affected zone, back lesions (specially the lumbar zone) and the upper zone (arms, shoulders, neck).

From the physical load imposed by the labour activity point of view, three types of tasks can be considered which include the major part of labours performed in industries, retail activities, building and construction, agricultural, and others.

- Manual handling of loads such as lifting loads, transport, dozing or dragging of loads.
- Repetitive movement cycles of the arms and/or the hands.
- Labours and activities that generate inadequate postures and/or efforts of the torso, or the arms and of the legs.

Lumbar lesions occur more frequently to workers that perform lifting of heavy loads (8 times more than sedentary workers). Studies have demonstrated that lifting loads which are heavier than 20 kg. (40 pounds) and repetitive loads are risk factors which can produce lumbar lesions. Additionally a relation has been observed between compression forces on the inter-vertebral discs L5/S1 and the lumbar lesion incidence.

U.S. Pat. No. 5,846,169 (the disclosure of which is incorporated by reference in its entirety) describes an apparatus which consists of a main supporting belt, with one or more rigid structures, directed towards the shoulders, whose function, is to make the user maintain a correct position of his spine, preventing inadequate movements of the shoulders and of the hips, it allows the distribution of the load lifted mainly, above the shoulders, however, said structure is designed for the correct distribution of the weight by always maintaining a static position; in contrast with the present invention, which allows to continue the correct distribution of the weight even if the user is moving.

The Japanese patent application JP 2004/283423 (the disclosure of which is incorporated by reference in its entirety) describes an apparatus which consists of a main support belt made of semi-rigid material, can be made of leather or elastic strips, which allows the users mobility, but at the same time maintaining the adequate position of the shoulders.

The French document FR 2,718,956 (the disclosure of which is incorporated by reference in its entirety) describes an apparatus which consists of a main belt, with one or more rigid structures directed toward the shoulders, which purpose is to obtain a correct position of the spine, with the objective of immobilizing a large portion of the spine. The application of said apparatus is to be used once the person has suffered a lumbar lesion and in no way as a measure to prevent said lesion.

The US document, US 2005/228,325 (the disclosure of which is incorporated by reference in its entirety) describes a support frame for the torso vertebrae of the spine, in the zone between the torso and the hips, which includes a hip closure supported on the hip and in the torso vertebrae zone, which is connected by means of a widening of the bars parallel to the spine, not considering the protection of the upper region.

The Japanese patent JP 2006/305,290 (the disclosure of which is incorporated by reference in its entirety) describes an apparatus made of a rigid central structure which is to be positioned over the spine of the user, where it is fixed by means of strips or belts around the shoulders and the waist, introducing the lower portion of said structure inside the pants of the user, allowing this way, that the user maintains the correct position of his back while performing different actions. This device does not guarantee the correct distribution of the load at the moment of the handling of said loads.

There are also, devices for the prevention of lumbar lesions which are related with apparatus which operate as lumbar supports, nearly all these apparatus refer to lumbar belts, among which, patents U.S. Pat. No. 5,560,046 and U.S. Pat. No. 5,499,965 (the disclosures of which are incorporated by reference in their entirety) can be found, which perform the function of protecting the users back, even though the efficiency of said apparatus can be questioned because the centre of the load pressure, is placed on the lumbar section of the spine.

DESCRIPTION OF THE INVENTION

This invention proposes an apparatus of the exo-skeletal type, which helps to prevent risky postures during the transport of loads and also helps to attain a better distribution of the load, in order to reduce the risk of lesions and allows the improvement of the efficiency of the worker, because the effort made is reduced when said device is used.

The apparatus described in the subject invention is an exo-skeletal structure, which forms a bridge between the load supported by the user and the user's spine, preventing a possible lesion that can affect the user, produced by the inadequate handling of the loads. The apparatus of this invention allows a better distribution of the weight of the load, thus preventing lesions of the lumbar zone.

This apparatus protects the user from the zone of the neck down to the hips, preventing that the user adopts postures that can harm the spine, such as torsions or flections.

The apparatus also has a support systems for the load which allows the handling of the load (it facilitates the movement of arms and legs), which helps the user in the transportation of loads.

The previous art documents, describe lumbar support apparatus, such as belts, which exert pressure on the lumbar zone, in order to maintain said zone immobilized (thus avoiding inadequate positions) but do not distribute the weight of the load to be transported, other devices are oriented to the protection of zones that have already been damaged. When a load is transported on the shoulders, these apparatus concentrate the weight of the load on the lumbar zone, producing a compression of the inter-vertebral discs in the spine.

load surface, (3) back surface, (4) back vertical support pillar, (5) projection, (6) girdle, (7) projection, (8) front vertical support pillar, (9) front surface, and upward vertical projection (1) close to the user's neck, and a second upward vertical projection (11).

Figure 1:
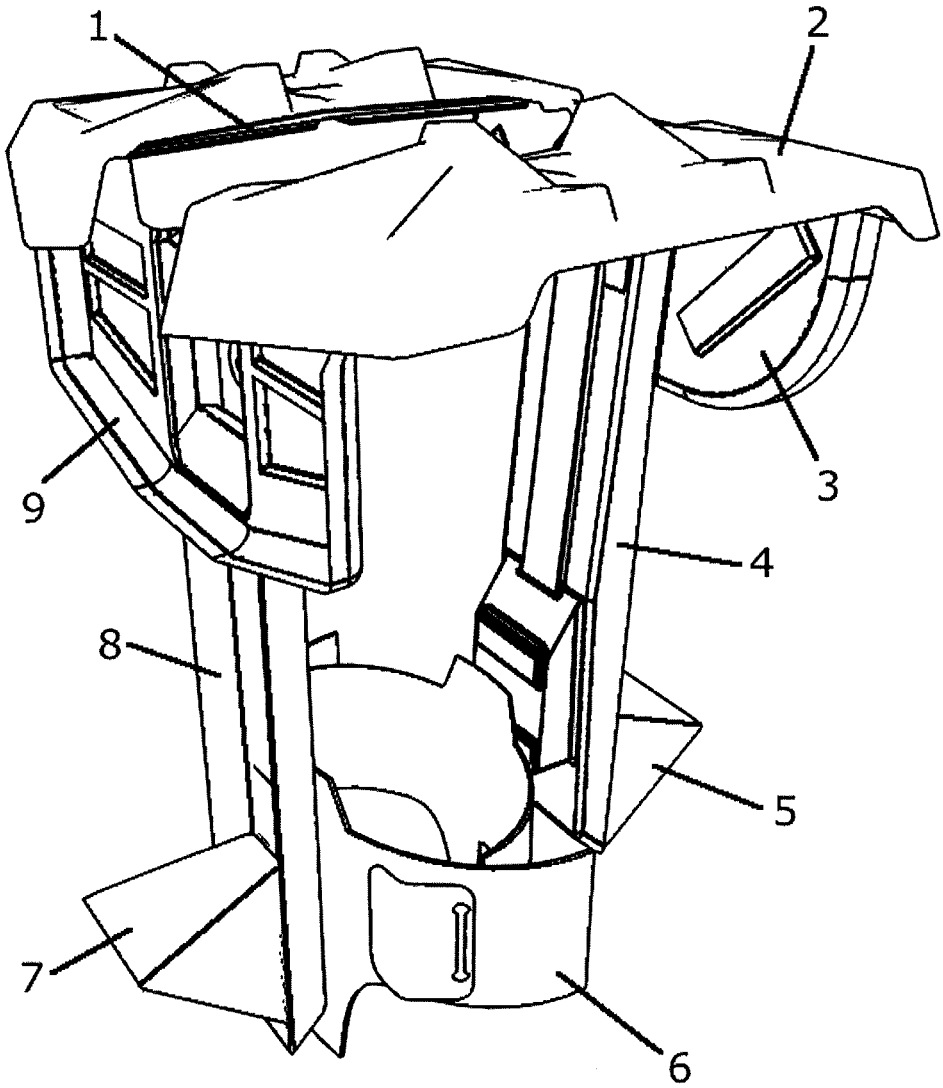
FIG. 1, shows an upper front view of an embodiment of subject invention, where (1) indicates a flat cross section, (2)
Figure 2:
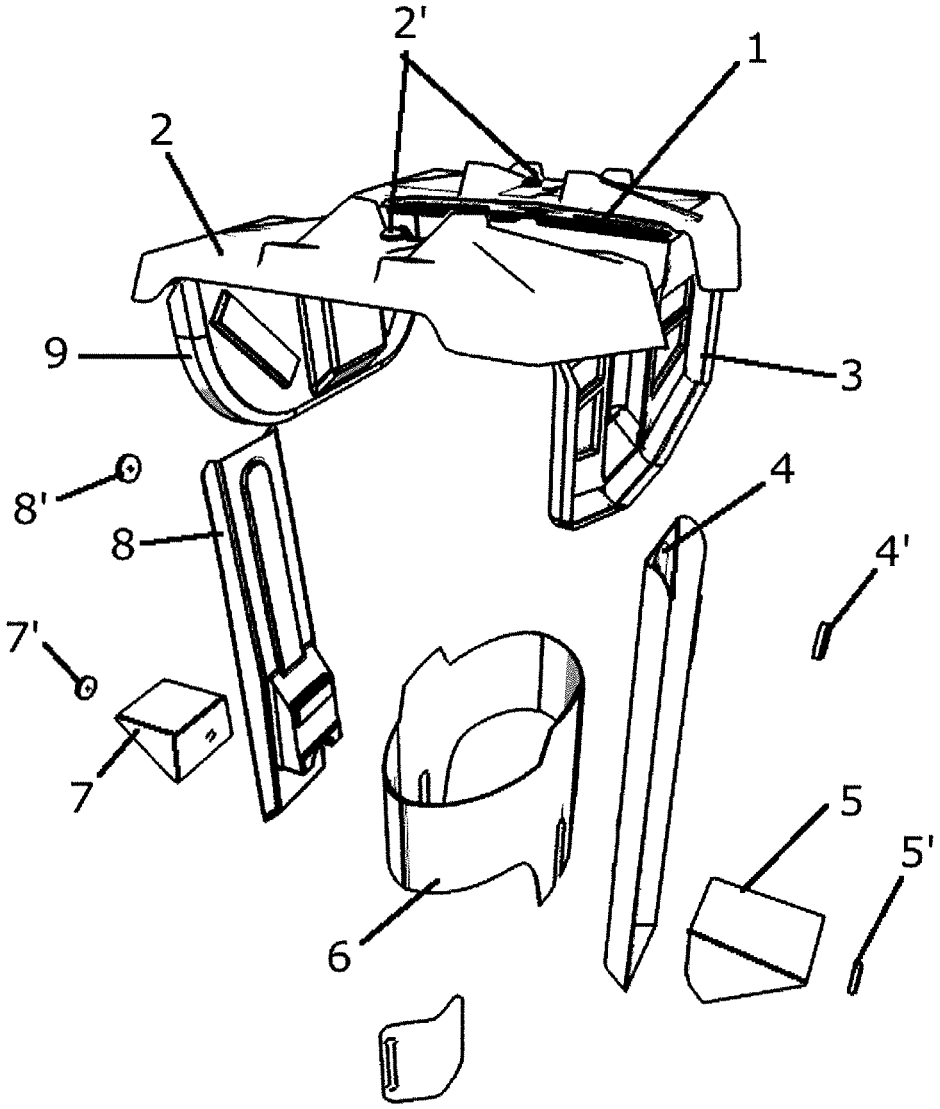

FIG. 2 shows a blow up of the device, in a different perspective, where 2', 4', 5', 7' and 8' show the adjustment means used in the embodiment shown in FIG. 1.

Figure 3:
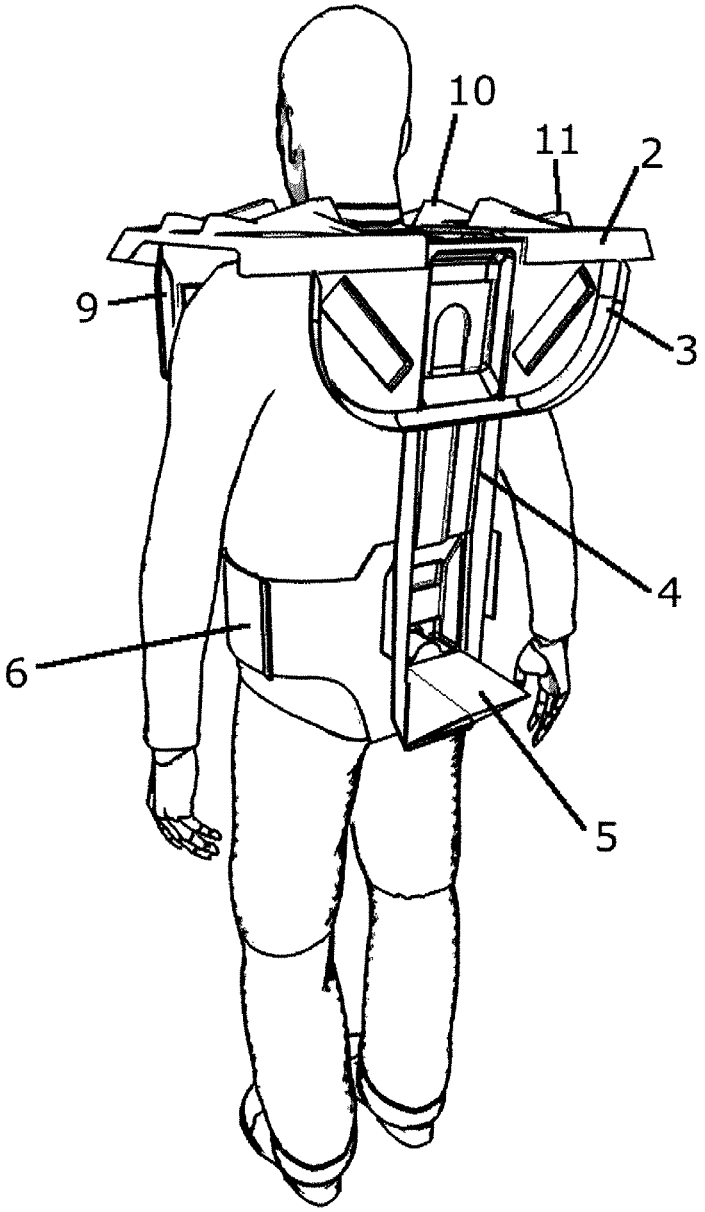

FIG. 3 shows the device in the present embodiment, as shown in the previous figures, placed on the user for the transportation of loads.

DETAILED DESCRIPTION OF THE INVENTION

The invention device is an exo-skeletal structure made of, preferably rigid materials, which do not allow its deformation during its use. Light materials are preferred, such as for example, but not limited to, some plastic materials. The device is made of rigid material so as to assure that the user cannot makes torsion movements that are a risk for his health, during the usage of the device.

The device of this invention, comprises at least a front surface 9 and a back surface 3, where said surfaces are defined according to their location on the body of the user, and are joined through their top portions by at least one flat cross surface 1 configured for use off the shoulders, at least one vertical support pillar 4 and 8 added to each front surface 9 and back surface 3, which are coupled through their top portions to the lower portions of the front surface 9 and back surface 3, the bottom portion of the at least one pillar being coupled to at least one girdle 6. Said front 9 and back 3 surfaces and flat cross section 1 which join to each other, form an indivisible unit which forms part of the central portion of the exo-skeletal structure and can carries inside of it, adjustment means.

In a preferred embodiment, the front surface 9, the back surface 3 and two flat cross sections 1, form the central structure of the exo-skeletal device and are associated to at least one front vertical support pillar 8 and at least to one back vertical support pillar 4, this last pillar covers the spinal zone of the user. The vertical support pillars 4 and 8 are coupled or assembled to the central structure through their top portion, by known coupling devices 4' and 8'.

The coupling devices 4' and 8' can also allow to adapt the device to the user's anatomy. The vertical support pillars have an internal face, being said internal face the one that is in contact with the user's body, coupling means where a girdle is secured by coupling devices, such as hooks 5' and 7' which hold it over the hip zone of the user. Said girdle has the function of supporting the device in a balanced position over the body of the user and distributing the load below the lumbar zone, helping this way to reduce the pressure on the spine and distributing the load towards the hips and the legs. In the external face of the vertical support pillars 4 and 8, being the external face, the face opposed to the internal face, which can be the face in contact with the transported load, said faces can have outward looking projections 5 and 7, which forms a support surface for the load to be transported. Said projections can form a one piece unit with the pillar, in case this is required for intensive transportation of loads, or it can be a part coupled to it and it this case it can be a fixed coupling (only one position) or it can be a coupling with various position alternatives.

Over the flat cross sections of the device, at least one load carrying surface 2 can be associated, which can have a larger area or a larger volume that the flat section itself, this facilitates positioning the load on it and allows its transportation, requiring the use of hands and arms only to avoid the loss of balance or the falling of the load.

In an embodiment of the invention, the load surface can have in the extreme border, closest to the neck and head of the user, an upward vertical projection 10 which prevents the loads sliding towards the head of the user and in the opposite extreme border of the neck and head of the user, it can have a second upward vertical projection 11, useful for the transportation of circular, cylindrical or curved loads in general.

In an embodiment, the load surface can have a concave surface, for its use in the transportation of curved loads, or loads without a definite shape, (such as sacs).

In another embodiment, the load surface can be flat without projections, which facilitate the transportation of boxes, cases or other paralelepipedic shape loads.

In yet another embodiment of the invention, the device has a width no larger than the shoulders or the torso of the user, and their front and back surfaces have a length enough to cover the pectoral zone, where the pillars extend from the front surface and the back surface, to the pelvic zone and below the lumbar zone. The sizes preferred in this invention are those sizes and proportions used in the safety and apparel industry.

An embodiment of the invention device has been developed and submitted to effort tests, thus demonstrating the improvement in the capacities of the user.

In laboratory tests the cardiac and lung capacities of the user were measured, using and not using the invention device, comparing the obtained results, determined an improvement in the efficiency when the device of the invention is used. The cardiac frequency of the user being submitted to the test, without the use of the invention device, is 135, when the user uses the device described in this invention, his heart frequency falls to 120, this being only one of the various parameters which show the improvement obtained when the device of the invention is used. Furthermore the BORG test was made during the experience, this being a subjective indicator used to measure the effort level that the user feels during the test. In addition to the previous observation, the user qualified the effort made without the device of the invention with an 8, while using the device of the invention, this index fell to a qualification of 4. It can be concluded that the user is capable of feeling and evaluating the benefit of using the invention device and the improvement can be represented by a reduction of 50% in the perception of efforts.

Another test performed was an electromyography. Surface electromyographic signals are obtained, during the flexion-relaxation tests, where the user realizes a maximal flexion of the torso, from a two feet standing position, to get back to the erected position again, always maintaining his knees extended. This study reveals which muscles where used (paraspinal muscles) and in what magnitude (measured in millivolts), Table 1 shows the results were obtained, where A shows the measurements realized without using the device of this invention and B shows the reading obtained when the user carries the invention device:

TABLE 1

| Para spinal muscle | EMG (A) | EMG (B) |
|---|---|---|
| Right lumbar multifidus | 8.40 mV | 7.50 mV |
| Left lumbar multifidus | 6.21 mV | 4.63 mV |
| Right lumbar ilicostal | 5.50 mV | 4.50 mV |
| Left lumbar ilicostal | 5.25 mV | 4.88 mV |
| Right long thoracic dorsal | 5.16 mV | 5.00 mV |
| Left long thoracic dorsal | 6.67 mV | 4.49 mV |

As it can be appreciated in Table 1, the electric activity results of the muscles are shown to be reduced with the use of the device of the present invention.

The invention claimed is:

1. A device for the manual transportation of loads, comprising at least a front surface and at least a back surface, where said front and back surfaces are defined according to their position on the body of the user, joined through their top portion by at least one flat cross surface, to each one of the front and back surface to which at least one vertical support pillar is added, wherein said at least one vertical support pillar is a rigid pillar and has a top portion that is coupled by adjustable means to a lower portion of the front surface and to a lower portion of the back surface, and said at least one vertical support pillar comprises a lower portion that is coupled to at least one girdle, and wherein said at least one front surface, said at least one back surface, and said at least one flat cross surface form one indivisible unit which forms the central structure of an exo-skeleton.

2. The device according to claim 1, comprising the at least one front surface, the at least one back surface, two flat cross surfaces, one front vertical support pillar, one back vertical support pillar and the girdle.

3. The device according to claim 1, additionally comprising at least one load surface located over the at least one flat cross surface.

4. The device according to claim 1, wherein said front and back surfaces are assembled through their lower portions with the upper portion of the front and back vertical support pillars by coupling devices, wherein the coupling devices are adjustable and used as means for adapting the device to the user.

5. The device according to claim 1, wherein said front and back vertical support pillars have in their lower portions, on their internal faces, defined according to how close are they located to the user, coupling devices for said at least one girdle.

6. The device according to claim 1, wherein said front and back vertical support pillars have at least one external projection on their external faces opposite the internal faces, and said at least one external projection is a horizontal surface as wide as the width of said front and back support pillars.

7. The device according to claim 6, wherein said at least one external projection and said at least one support pillar, forms one single piece.

8. The device according to claim 1, wherein said at least one girdle connects said at least one vertical support pillar for holding and supporting the device on the hips of the user.

9. The device according to claim 1, wherein said device is made with light and rigid materials that do not deform, including a plastic material.

10. Use of the device according to claim 1 for the manual transport of loads, to prevent risky torsions and movements that could endanger the health of the spine of the user, to improve the efficiency of the user during transportation of loads, and to help prevent muscle-skeletal lesion.

11. The device according to claim 1 wherein the at least one flat cross surface is configured to be used off the shoulders, and wherein the at least one support pillar is at least one vertical support pillar.

12. A device for the manual transportation of loads, comprising at least a front surface and at least a back surface, where said front and back surfaces are defined according to their position on the body of the user, joined through their top portion by at least one flat cross surface, to each one of the front and back surface to which at least one vertical support pillar is added, wherein said at least one vertical support pillar is a rigid pillar and has a top portion that is coupled by adjustable means to a lower portion of the front surface and to a lower portion of the back surface, and said at least one vertical support pillar comprises a lower portion that is coupled to at least one girdle, and additionally comprising at least one load surface located over the at least one flat cross surface, and wherein said at least one load surface is larger in size than the at least one flat cross surface.

13. The device according to claim 12, comprising the at least one front surface, the at least one back surface, two flat cross surfaces, one front vertical support pillar, one back vertical support pillar and the girdle.

14. The device according to claim 12, additionally comprising at least one load surface located over the at least one flat cross surface.

15. A device for the manual transportation of loads, comprising at least a front surface and at least a back surface, where said front and back surfaces are defined according to their position on the body of the user, joined through their top portion by at least one flat cross surface, to each one of the front and back surface to which at least one vertical support pillar is added, wherein said at least one vertical support pillar is a rigid pillar and has a top portion that is coupled by adjustable means to a lower portion of the front surface and to a lower portion of the back surface, and said at least one vertical support pillar comprises a lower portion that is coupled to at least one girdle, and additionally comprising at least one load surface located over the at least one flat cross surface, and wherein said at least one load surface has one or more upward vertical projections.

16. The device according to claim 15, wherein said one or more upward vertical projections is located at the extreme border closest to the user.

17. The device according to claim 15, wherein said one or more upward vertical projections are located on the opposite extreme border far vertically from the user's body.

18. The device according to claim 15, comprising the at least one front surface, the at least one back surface, two flat cross surfaces, one front vertical support pillar, one back vertical support pillar and the girdle.

19. The device according to claim 15, additionally comprising at least one load surface located over the at least one flat cross surface.

20. A device for the manual transportation of loads, comprising at least a front surface and at least a back surface, where said front and back surfaces are defined according to their position on the body of the user, joined through their top portion by at least one flat cross surface, to each one of the front and back surface to which at least one vertical support pillar is added, wherein said at least one vertical support pillar is a rigid pillar and has a top portion that is coupled by adjustable means to a lower portion of the front surface and to a lower portion of the back surface, and said at least one vertical support pillar comprises a lower portion that is coupled to at least one girdle, and additionally comprising at least one load surface located over the at least one flat cross surface, and wherein said at least one load surface has a concave form in which a load fits.

21. A device for the manual transportation of loads, comprising at least a front surface and at least a back surface, where said front and back surfaces are defined according to their position on the body of the user, joined through their top portion by at least one flat cross surface, to each one of the front and back surface to which at least one vertical support pillar is added, wherein said at least one vertical support pillar is a rigid pillar and has a top portion that is coupled by adjustable means to a lower portion of the front surface and to a lower portion of the back surface, and said at least one vertical support pillar comprises a lower portion that is coupled to at least one girdle, and additionally comprising at least one load surface located over the at least one flat cross surface, and wherein said front and back vertical support pillars have at least one external projection on their external faces opposite the internal faces, and said at least one external projection is a horizontal surface as wide as the width of said front and back support pillars, and wherein said at least one external projection can be coupled to said at least one support pillar through adjustable coupling means.

22. The device according to claim 21, wherein said at least one external projection is coupled to said at least one vertical support pillar in a position chosen by the user.

* * * * *